US010760567B2

(12) United States Patent
Salih et al.

(10) Patent No.: US 10,760,567 B2
(45) Date of Patent: Sep. 1, 2020

(54) FLUID END ASSEMBLY OF A RECIPROCATING PUMP

(71) Applicant: A.H.M.S., Inc., Edmonton (CA)

(72) Inventors: Nabeel Salih, Edmonton (CA); Carey Philip Nagel, Edmonton (CA); Jie Chen, Edmonton (CA); Michel Anthony Riou, Edmonton (CA)

(73) Assignee: A.H.M.S., INC., Edmonton (CA)

( * ) Notice: Subject to any disclaimer, the term of this patent is extended or adjusted under 35 U.S.C. 154(b) by 149 days.

(21) Appl. No.: 16/060,181

(22) PCT Filed: Dec. 9, 2016

(86) PCT No.: PCT/CA2016/051453
§ 371 (c)(1),
(2) Date: Jun. 7, 2018

(87) PCT Pub. No.: WO2017/096488
PCT Pub. Date: Jun. 15, 2017

(65) Prior Publication Data

US 2018/0363642 A1 Dec. 20, 2018

Related U.S. Application Data

(60) Provisional application No. 62/265,909, filed on Dec. 10, 2015.

(51) Int. Cl.
*F04B 53/10* (2006.01)
*F04B 53/16* (2006.01)
(Continued)

(52) U.S. Cl.
CPC ..... *F04B 53/1027* (2013.01); *F04B 15/02* (2013.01); *F04B 47/00* (2013.01);
(Continued)

(58) Field of Classification Search
None
See application file for complete search history.

(56) References Cited

U.S. PATENT DOCUMENTS 3,427,988 A * 2/1969 Schmieman ..... F04B 53/10 417/569
4,768,933 A 9/1988 Stachowiak
(Continued)

FOREIGN PATENT DOCUMENTS

CN 2220538 2/1996
CN 2481877 3/2002

*Primary Examiner* — Peter J Bertheaud
*Assistant Examiner* — Geoffrey S Lee
(74) *Attorney, Agent, or Firm* — Kirsten M. Oates; Rodman & Rodman LLP

(57) ABSTRACT

A fluid end assembly of a reciprocating pump has multiple fluid end bodies that are removably attached, independently of each other, to a power end assembly of the reciprocating pump, and to a manifold of the fluid end assembly. Each fluid end body defines a discharge outlet that is coaxial with a plunger bore for a reciprocating plunger, and a suction inlet that is disposed above the discharge outlet. A valve assembly is removably insertable into a valve port extending from an external surface of a manifold attached to the fluid end body, without having to remove the manifold from the fluid end body. The valve assembly includes a valve mechanism surrounded by a cylindrical valve body that lines the internal wall of the manifold defining the valve port, thereby forming a barrier between fluid flowing through the valve assembly and the internal wall.

11 Claims, 6 Drawing Sheets

(51) Int. Cl.

| | |
|---|---|
| ***F04B 39/14*** | (2006.01) |
| ***F04B 47/02*** | (2006.01) |
| ***F04B 47/00*** | (2006.01) |
| ***F04B 15/02*** | (2006.01) |

(52) U.S. Cl.
CPC ..... *F04B 47/02* (2013.01); *F04B 53/10* (2013.01); *F04B 53/1025* (2013.01); *F04B 53/16* (2013.01); *F04B 39/14* (2013.01)

(56) References Cited

U.S. PATENT DOCUMENTS 5,112,196 A * 5/1992 Schuh ..... F04B 51/00 417/53
5,171,136 A * 12/1992 Pacht ..... F04B 53/1025 137/454.4
5,253,987 A * 10/1993 Harrison ..... F04B 53/06 137/543.19
5,362,215 A * 11/1994 King ..... F04B 49/10 137/542
7,121,812 B2 * 10/2006 Forrest ..... F04B 53/22 417/269
7,364,412 B2 4/2008 Kugelev et al.
8,337,180 B2 12/2012 Whaley et al.
8,365,754 B2 * 2/2013 Riley ..... F04B 39/121 137/15.17
8,528,462 B2 * 9/2013 Pacht ..... F04B 53/147 92/128
2006/0216177 A1 * 9/2006 Warren ..... F04B 53/06 417/571
2010/0054974 A1 * 3/2010 Riley ..... F04B 53/007 417/437
2011/0138997 A1 * 6/2011 Pacht ..... F04B 1/0408 92/161
2011/0142699 A1 * 6/2011 Pacht ..... F04B 53/147 417/437
2011/0283537 A1 * 11/2011 Case ..... B25B 23/0078 29/890.124
2012/0288387 A1 11/2012 Freed et al.
2014/0286805 A1 * 9/2014 Dyer ..... F04B 49/22 417/570

* cited by examiner

FLUID END ASSEMBLY OF A RECIPROCATING PUMP

TECHNICAL FIELD

This present invention relates to fluid end assemblies of reciprocating pumps.

BACKGROUND OF THE INVENTION

Reciprocating pumps conventionally comprise a "power end assembly" and a "fluid end assembly". In the power end assembly, rotational movement of a driveshaft drives reciprocating movement of a plunger. In the fluid end assembly, a fluid end body defines a plunger bore in fluid communication with a suction manifold via a suction valve, and in fluid communication with a discharge manifold via a discharge valve. Movement of the plunger in one direction within the plunger bore decreases the pressure of a working fluid in the plunger bore, thus closing the discharge valve and opening the suction valve to allow additional working fluid to flow from the suction manifold into the plunger bore. Movement of the plunger in the opposite direction within the plunger bore pressurizes the working fluid in the plunger bore, thus closing the suction valve and opening the discharge valve to allow working fluid in the plunger bore to flow into the discharge manifold. The foregoing suction and discharge cycles repeat as the plunger moves in alternating directions within the plunger bore.

Erosion, mechanical stress and fatigue of fluid end bodies are acute problems when reciprocating pumps are used to pump abrasive fracturing fluids at ultra-high pressures for hydraulic fracturing operations. Cracking of internal bores and valve seat decks and corrosion of the internal bores of the fluid end body have been observed in practice. Regions of the fluid end body in the vicinity of the valves are particularly susceptible to erosion. These phenomena may lead to failure, reduced performance, and shortened service life of fluid end bodies.

Conventional fluid end bodies have an internal cross-bore configuration with the suction valve and discharge valve received in coaxial, vertically oriented bores for vertical flow of the working fluid from the suction valve upwards towards the discharge valve, and the plunger bore being horizontally oriented for horizontal movement of the reciprocating plunger. This cross-bore configuration results in acceleration of the working fluid from a horizontal direction to a vertical direction as it is pressurized from the plunger bore to the discharge valve and results in geometric discontinuities internal to the fluid end body, which can exacerbate erosion and undesirable mechanical stresses in the fluid end body.

Conventional fluid end bodies have complex contoured and tapered internal bores to receive and retain the valves. Valve seat members made of materials such as hardened steel are forcibly inserted into the internal bores, so that the valve seat members are compressed and wedged into the internal bores, and retained therein by fiction fit. This creates internal mechanical stresses in the valve seat members and the fluid end body, which may be further concentrated by the geometric discontinuities of the contoured and tapered internal bores. The manifolds are then attached to the fluid end bodies. The manifolds must be removed to extract the valves from the internal bores.

Conventional fluid end bodies comprise a single monolithic block defining multiple plunger bores to accommodate multiple plungers. Accordingly, even if damage to the fluid end body is localized at one of the plunger bores, the entire fluid end body must be removed from the power end assembly to service the fluid end body. Further, if the localized damage cannot be repaired, the entire fluid end body must be replaced.

There remains a need in the art for a fluid end assembly that is resistant to wear and failure, and is convenient and economical to service.

SUMMARY OF THE INVENTION

The present invention relates to a fluid end assembly of a reciprocating pump, and to a fluid end body and a valve assembly thereof. Any term or expression not expressly defined herein shall have its commonly accepted definition understood by a person skilled in the art. In this document, "manifold" may refer to either a suction manifold or a discharge manifold of a fluid end body. In this document, "manifold fluid aperture" may refer to either a suction manifold inlet, which in use is connected to a suction line that supplies working fluid to the fluid end assembly, or a discharge manifold outlet, which in use is connected to a discharge line that conveys working fluid away from the fluid end assembly. In this document, a "valve" component may refer to either a "suction valve" component associated with a suction valve assembly that regulates fluid communication from the suction manifold inlet to the fluid end body, or a "discharge valve" component associated with a discharge valve assembly that regulates fluid communication from the fluid end body to the discharge manifold outlet.

In one aspect, the present invention comprises a fluid end assembly for use with a reciprocating pump comprising a reciprocating plunger. The fluid end assembly comprises a fluid end body defining: a fluid end body plunger bore for receiving the reciprocating plunger; a fluid end body suction inlet in fluid communication with the fluid end body plunger bore; and a fluid end body discharge outlet in fluid communication with the fluid end body plunger bore. The fluid end assembly further comprises a manifold attached to the fluid end body and defining a manifold fluid aperture, and a valve port extending inwardly from an external surface of the manifold. The fluid end assembly further comprises a valve assembly comprising: a valve mechanism variable between an open state and a closed state, wherein an open area of a valve aperture permitting fluid communication between the manifold fluid aperture and the plunger bore is greater in the open state than in the closed state; and a valve body for retaining the valve mechanism, wherein the valve body is sized and shaped for insertion into and removal from the valve port while the manifold is attached to the fluid end body.

In embodiments of the fluid end assembly, movement of the valve assembly within the valve port may limited by one or a combination of abutment between the valve body and an internal shoulder defined by the manifold, and abutment between the valve body and a retaining member removably attachable to the manifold, such as with a threaded connection.

In embodiments of the fluid end assembly, the valve body defines an outer envelope around a portion or all of the valve mechanism. The outer envelope may be shaped to line an internal wall of the manifold defining the valve port, thereby forming a barrier between fluid flowing through the valve assembly and the internal wall. The outer envelope may be substantially cylindrical in shape.

In embodiments of the fluid end assembly, the reciprocating pump comprises a plurality of the reciprocating plungers, and the fluid end assembly comprises a plurality of the fluid end bodies corresponding in number to number of reciprocating plungers. The fluid end bodies may be separate from each other, and removably attachable directly or indirectly to one or a combination of the power end assembly and the manifold, independently of the other fluid end bodies.

In embodiments of the fluid end assembly, the fluid end body plunger bore and the fluid end body discharge outlet are coaxially aligned with each other.

In embodiments of the fluid end assembly, fluid end body suction inlet is disposed above the fluid end body discharge outlet.

In another aspect, the present invention comprises a valve assembly for use in a fluid end assembly comprising a manifold defining a manifold fluid aperture and a fluid end body defining a plunger bore, the valve assembly comprising: a valve mechanism variable between an open state and a closed state, wherein an open area of a valve aperture permitting fluid communication between the manifold fluid aperture and the plunger bore is greater in the open state than in the closed state; and a valve body for engagement with the fluid end body, wherein the valve body defines an outer envelope around a portion or all of the valve mechanism.

In embodiments of the valve assembly, valve body is shaped to line an internal wall of the manifold defining a valve port that receives the valve assembly.

In embodiments of the valve assembly, the outer envelope is substantially cylindrical in shape.

In another aspect, the present invention comprises a fluid end body of a fluid end assembly of a reciprocating pump comprising a reciprocating plunger. The fluid end body defines: a fluid end body plunger bore for receiving the reciprocating plunger; a fluid end body suction inlet in fluid communication with the fluid end body plunger bore; and a fluid end body discharge outlet in fluid communication with the fluid end body plunger bore. The fluid end body plunger bore and the fluid end body discharge outlet are coaxially aligned with each other.

In embodiments of the fluid end body, the fluid end body suction inlet is disposed above the fluid end body discharge outlet.

BRIEF DESCRIPTION OF DRAWINGS

Exemplary embodiments of the present invention are described with reference to the following drawings. In the drawings, like elements are assigned like reference numerals. The drawings are not necessarily to scale, with the emphasis instead placed upon the principles of the present invention. Additionally, each of the embodiments depicted is but one of a number of possible arrangements utilizing the fundamental concepts of the present invention. The drawings are briefly described as follows.

DETAILED DESCRIPTION OF THE INVENTION

With reference to FIGS. 1 to 10, a non-limiting exemplary embodiment of a fluid end assembly (10) of the present invention is now described. It will be understood that references in this document to orientations and directions are used only for convenient discussion to describe the relationship between parts, and do not limit the orientation of the fluid end assembly (10) in use. When referring to FIGS. 1 to 10, "front", "foward" and the like terms refer to the direction proximal to the discharge manifold (70), while "rear", "rearwards" and the like terms refer to the direction distal to the discharge manifold (70).

Figure 1:
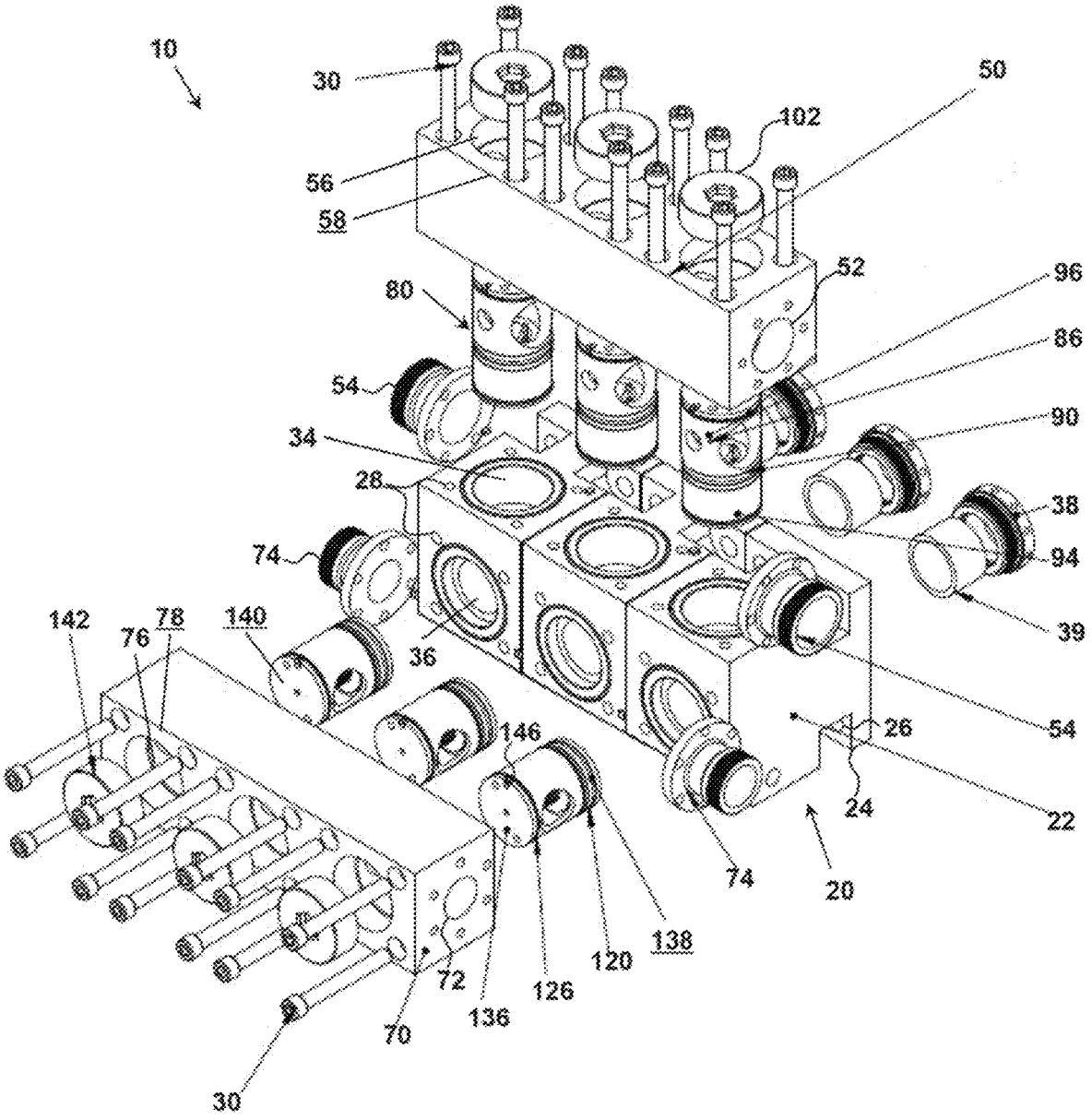
FIG. 1 is an exploded front perspective view of an embodiment of a fluid end assembly of the present invention.
Figure 2:
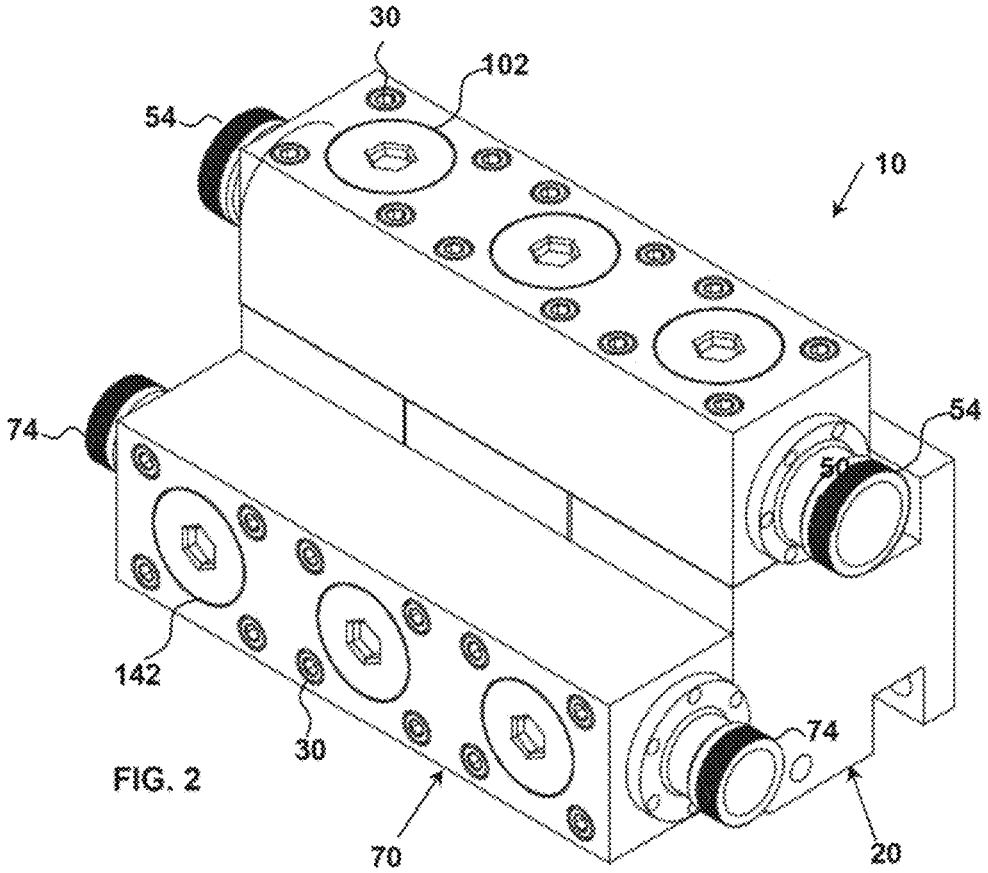
FIG. 2 is an assembled front perspective view of the embodiment of the fluid end assembly shown in FIG. 1.

Referring to the embodiment shown in FIG. 1, in general, the fluid end assembly (10) comprises at least one fluid end body (20), a suction manifold (50), a discharge manifold (70), at least one suction valve assembly (80), and at least one discharge valve assembly (120). Each of these parts may be formed from materials that are suitably strong to withstand expected operating conditions of the fluid end assembly (10), including without limitation high strength alloy steels such as American Iron and Steel Institute (AISI) grade 4340 alloy steel.

Figure 6:
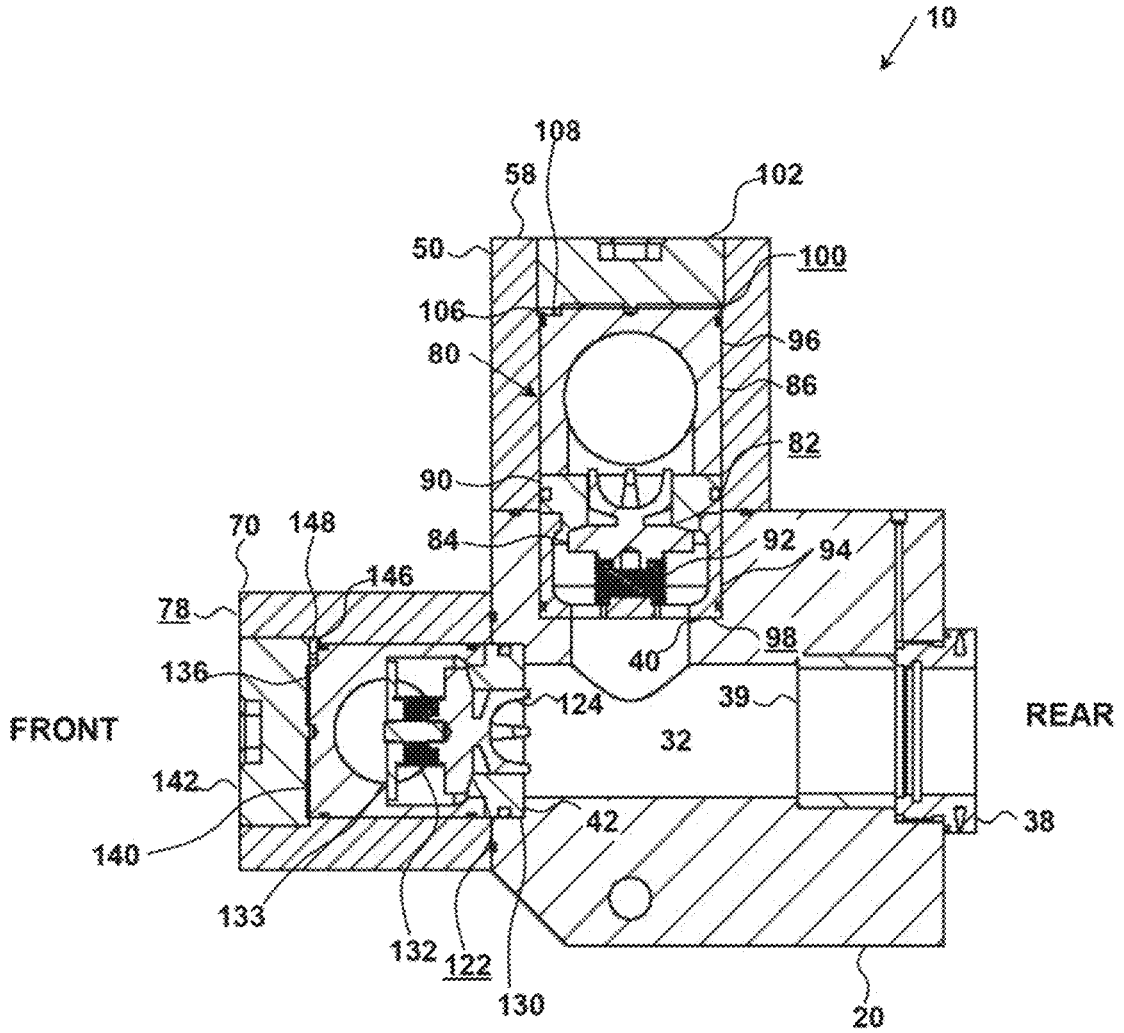
FIG. 6 is a cross-sectional view of the embodiment of the fluid end assembly shown FIG. 1, as viewed along section line A-A of FIG. 4.

In use and operation, the fluid end assembly (10) is attached to a power end assembly (not shown) to form a reciprocal pump. As the reciprocating plunger moves in a rearward direction within fluid end body plunger bore (32) (as shown in FIG. 6), the working fluid pressure within the fluid end body plunger bore (32) decreases, causing the suction valve assembly (80) to move from a closed state to an open state, and the discharge valve assembly (120) to move from an open state to a closed state, and thereby draw additional working fluid from the suction manifold (50) into the fluid end body plunger bore (32). Conversely, when the reciprocating plunger moves forwards within the fluid end body plunger bore (32), the working fluid pressure within the fluid end body plunger bore (32) increases, causing the suction valve assembly (80) to move from an open state to a closed state, and the discharge valve assembly (120) to move from a closed state to an open state, and thereby discharge working fluid from the fluid end body plunger bore (32) into the discharge manifold (70).

Figure 3:
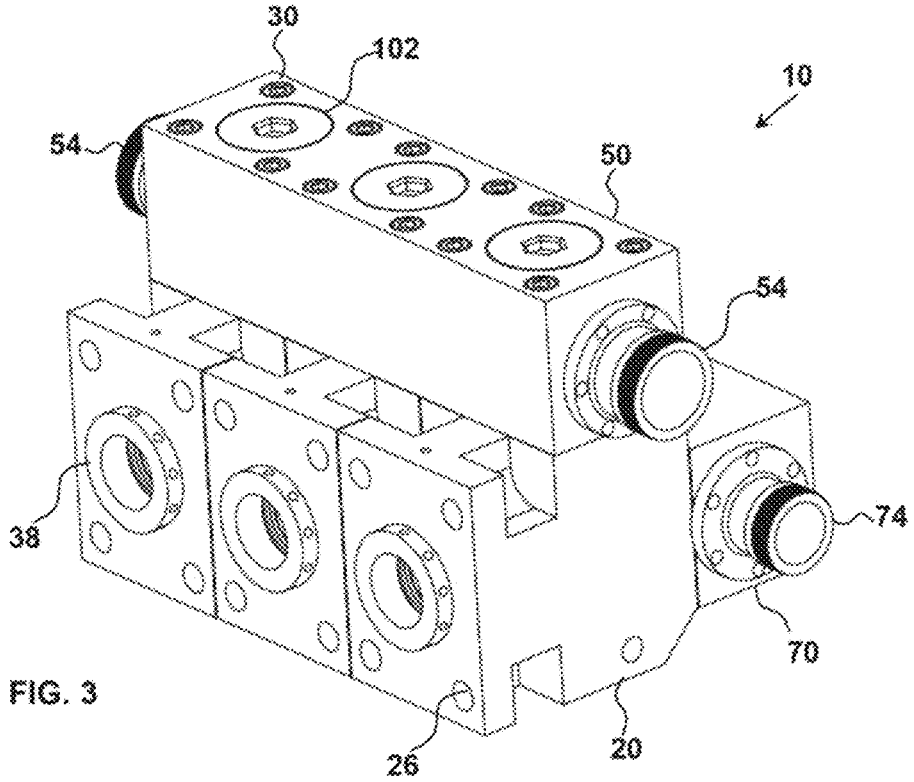
FIG. 3 is an assembled rear perspective view of the embodiment of the fluid end assembly shown in FIG. 1.
Figure 4:
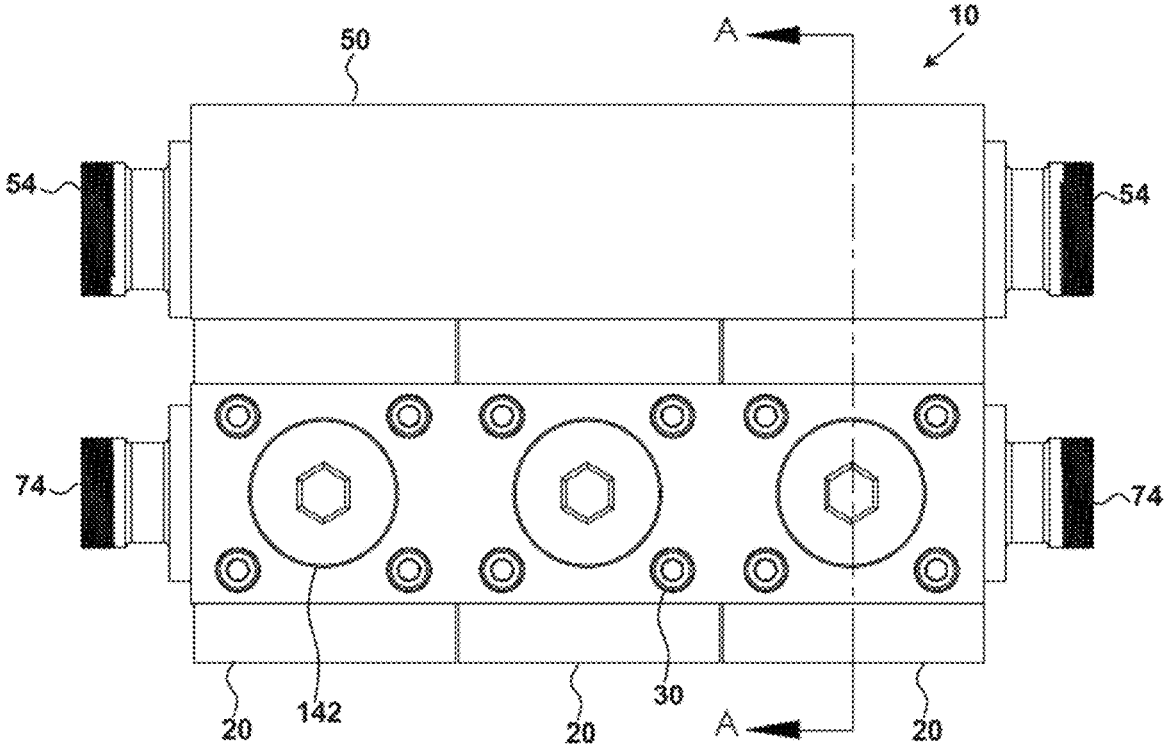
FIG. 4 is an assembled front elevation view of the embodiment of the fluid end assembly shown in FIG. 1.
Figure 5:
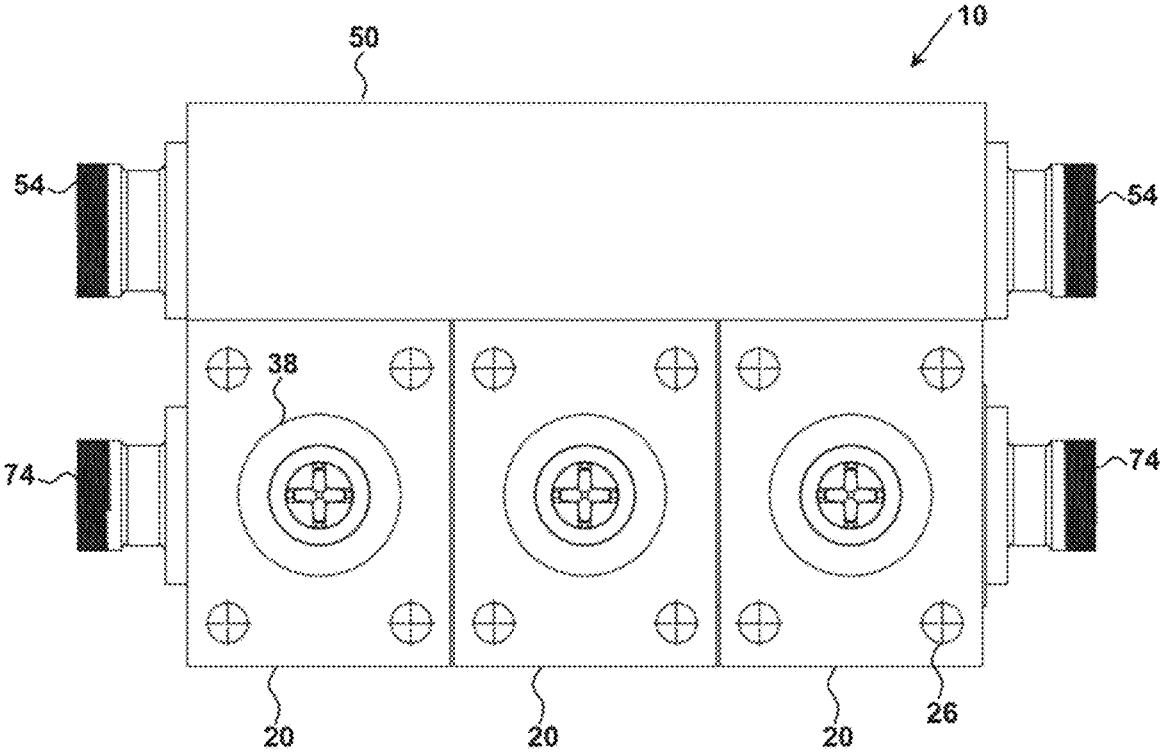
FIG. 5 is an assembled rear elevation view of the embodiment of the fluid end assembly shown in FIG. 1.

Fluid end body. In use, each fluid end body (20) is attached to the power end assembly (not shown), the suction manifold (50) and the discharge manifold (70). As shown in FIG. 1, each fluid end body (20) defines a fluid end body plunger bore (32), a fluid end body suction inlet (34), and a fluid end body discharge outlet (36). The fluid end plunger bore (32) receives one of the reciprocating plungers (not shown) of a power end assembly. The fluid end body suction inlet (34) permits fluid communication between the fluid end body plunger bore (32) and the suction manifold (50). The fluid end body discharge outlet (36) permits fluid communication between the fluid end body plunger bore (32) and the discharge manifold (70). In the exemplary embodiment, as shown in FIGS. 3 and 6, a locking nut (38) and packing (39) assembly provides a fluid-tight connection between the fluid end body plunger bore (32) and the power end assembly (not shown).

The fluid end assembly (10) may have any number of fluid end bodies (20). In the exemplary embodiment, the fluid end assembly (10) has three identical fluid end bodies (20) for a reciprocal pump having a triplex configuration. In alternative embodiments (not shown), the fluid end bodies (20) may be dissimilar. Each of the fluid end bodies (20) is formed separately from the others. In the exemplary embodiment, each fluid end body (20) generally comprises a monolithically formed fluid end body block (22) that defines one of the fluid end plunger bores (32), and a fluid end body attachment member (24) in the form of a fluid end body flange. In other embodiments (not shown), the fluid end body attachment member (24) may be formed separately from the fluid end body block (22) and attached to the fluid end body block (22), and the fluid end body attachment member (24) may be in a form other than a flange. Each of the fluid end body flanges defines a plurality of fluid end body attachment member bolt holes (26) to allow for removable attachment of the fluid end body (20) to the power end assembly (not shown) of the reciprocal pump. Further, each of the fluid end body blocks (22) defines threaded fluid end body block bolt holes (28) to receive bolts (30) for removable attachment to the suction manifold (50) and the discharge manifold (70). It will therefore be appreciated that each fluid end body (20) may be independently removed from the power end assembly, the suction manifold (50) and the discharge manifold (70), for servicing, without having to remove the other fluid end bodies (20) from the suction manifold (5) and the discharge manifold (70). In comparison with conventional fluid end bodies that monolithically define a plurality of plunger bores, this may allow for a reduction of servicing and replacement costs associated with the fluid end body (20), such as when only a portion of the fluid end body (20) defining one of the fluid end plunger bores (32) is damaged.

In the exemplary embodiment, referring to FIG. 6, the fluid end body plunger bore (32) extends axially from the rear end of the fluid end body (20) to the fluid end body discharge outlet (36) formed at the front of the fluid end body (20), so that the reciprocating plunger of the power end assembly moves within the fluid end plunger bore (32) alternately between a forward direction and a rearward direction. Further, the fluid end body plunger bore (32) and the fluid end body discharge outlet (36) are coaxial with each other. This "in-line" configuration of the fluid end body plunger bore (32) and the fluid end body discharge outlet (36) allows for a substantially linear flow path of the working fluid out of the fluid end body discharge outlet (36) when the working fluid is pressurized by the forward movement of the reciprocating plunger (not shown) within the fluid end body plunger bore (32). In comparison with conventional fluid end bodies having a cross bore configuration, this may allow for a reduction in internal geometric discontinuities and may reduce operating mechanical stresses on the fluid end body (20), so as to mitigate erosion, cracking and fatigue phenomenon.

In the exemplary embodiment, the fluid end body suction inlet (34) is disposed above the fluid end body discharge outlet (36), such that suction manifold (50) is disposed above the discharge manifold (70). A potential operational benefit of this configuration is that it facilitates purging of working fluid from the fluid end body (20), for purposes such as avoiding freezing of the working fluid within the fluid end body (20). This purging may be accomplished by running the reciprocating pump at a relatively low speed, while opening a port in a suction line attached to the suction manifold (50) to allow air into fluid end body (20) via the fluid end body suction inlet (34). Any working fluid that has collected in the fluid end body (20) is pressurized through the fluid end body discharge outlet (36) by the resulting body of pressurized air that forms in the fluid end body (20) above the working fluid. In contrast, conventional fluid end assemblies require that the suction manifold and parts internal to the fluid end assembly be removed to allow working fluid to drain out. This is because, in the conventional fluid end body, the fluid end body suction inlet is below the fluid end body discharge outlet, such that the working fluid tends to remain below the fluid end body discharge outlet unless pressurized out of the fluid end body during operation of the reciprocating pump.

Suction manifold. The suction manifold (50) permits fluid communication from one or more suction lines (not shown) of the pumping system to the fluid end body suction inlets (34). In the exemplary embodiment, the suction manifold (50) defines two suction manifold inlets (52), each having suction flanges (54) that allow for a fluid-tight connection to the suction lines (not shown). In the exemplary embodiment, the suction manifold (50) is formed as a single part that is separate from the fluid end bodies, and removably attached to the fluid end bodies (20) by threaded bolts (30), as discussed above. In other embodiments of the invention (not shown), where the removability of the suction manifold (50) from the fluid end bodies (20) is not an essential aspect of the invention, the suction manifold (50) may be formed monolithically with the fluid end bodies (20).

In the exemplary embodiment, the suction manifold (50) defines a plurality of suction valve ports (56) extending inwardly from a suction manifold external surface (58). In the exemplary embodiment, each of the fluid end bodies (20) also partially defines one of the suction valve ports (56). In other embodiments (not shown), the suction manifold (50) may wholly define the suction valve ports (56). Each of the suction valve ports (56) receives one of the suction valve assemblies (80), as discussed below. Referring to FIG. 6, in the exemplary embodiment, it will be noted that the internal wall of the suction manifold (50) defining the suction valve port (56) is substantially cylindrical and non-tapered. In comparison with conventional fluid end bodies having contoured or tapered internal bores to retain valve assemblies, this may avoid stress concentrations in the portions of the suction manifold (50) and fluid end body (20) that define the suction valve ports (56).

Discharge manifold. The discharge manifold (70) permits fluid communication from the fluid end body discharge outlets (36) to one or more discharge lines (not shown) of the pumping system. In the exemplary embodiment, the discharge manifold (70) defines two discharge manifold outlets (72), each having discharge flanges (74) that allow for a fluid-tight connection to the discharge lines (not shown). In the exemplary embodiment, the discharge manifold (70) is formed as a simile part that is separate from the fluid end bodies (20), and removably attached to the fluid end bodies (20) by threaded bolts (30), as discussed above. In other embodiments of the invention (not shown), where the removability of the discharge manifold (70) from the fluid end bodies (20) is not an essential aspect of the invention, the suction manifold (70) may be formed monolithically with the fluid end bodies (20).

In the exemplary embodiment, the discharge manifold (70) defines a plurality of discharge valve ports (76) extending rearwards from a discharge manifold external surface (78). In the exemplary embodiment, each of the fluid end bodies (20) also partially defines one of the discharge valve ports (76). In other embodiments (not shown), the discharge manifold (70) may wholly define the discharge valve ports (76). Each of the discharge valve ports (76) receives one of the discharge valve assemblies (120), as discussed below. Referring to FIG. 6, in the exemplary embodiment, it will be noted that the internal wall of the discharge manifold (70) defining the discharge valve port (76) is substantially cylindrical and non-tapered. In comparison with conventional fluid end bodies having contoured or tapered internal bores to retain valve assemblies, this may avoid stress concentrations in the portions of the discharge manifold (70) and fluid end body (20) that define the discharge valve ports (76).

Suction valve assembly. A purpose of the suction valve assembly (80) is to regulate fluid communication between a suction manifold inlet (52) of the suction manifold, and the fluid end body suction inlet (34) of the fluid end body (20). The suction valve assembly comprises a suction valve mechanism that is variable between an open state and a closed state. In the open state, the suction valve mechanism defines a suction valve aperture permitting fluid communication between the suction valve manifold inlet (52) and the fluid end body suction inlet (34). In the closed state, the suction valve mechanism may entirely close or reduce the open area of the suction valve aperture, relative to the open state, thereby preventing or restricting fluid communication through the suction valve mechanism.

Figure 7:
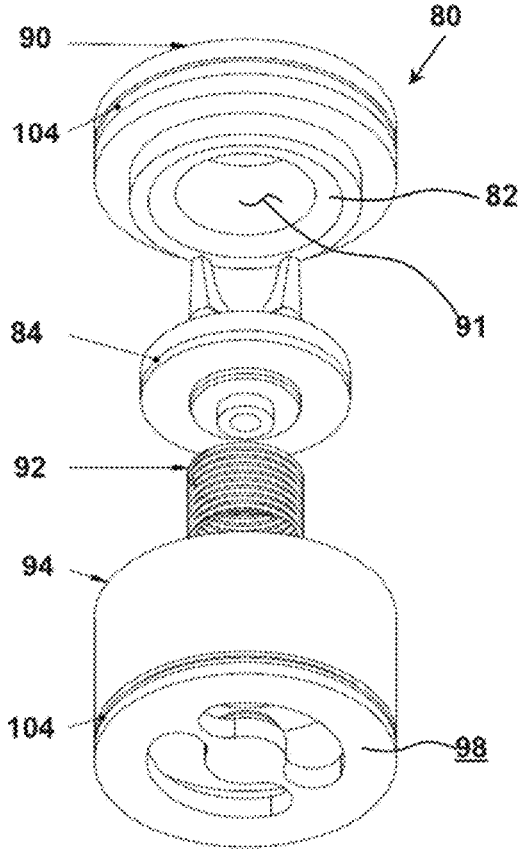
FIG. 7 is an exploded perspective view of part of an embodiment of a suction valve assembly of the embodiment of the fluid end assembly shown in FIG. 1.
Figure 8:
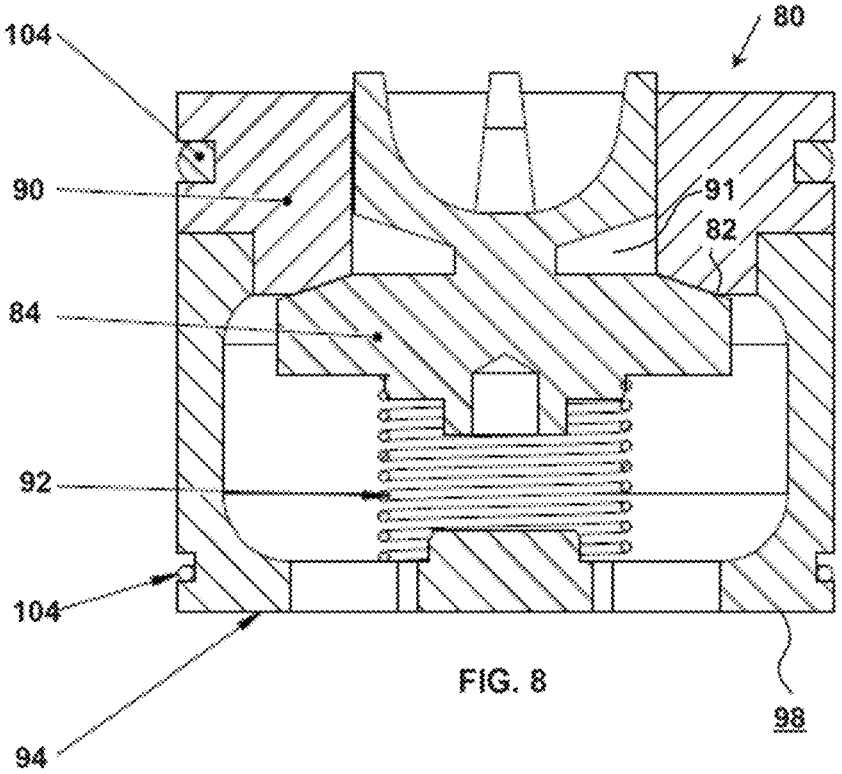
FIG. 8 is a mid-line cross-sectional view of the part of the embodiment of the suction valve assembly shown in FIG. 7.

In the exemplary embodiment, as shown in FIG. 7, the suction valve assembly (80) comprises a suction valve seat member (90) having a conical-section suction valve seat surface (82), a suction valve moving member (84), and a suction valve spring (92). The suction valve seat member (90) defines a suction valve aperture (91) permitting fluid communication between the suction manifold (50) and the fluid end body suction inlet (34). The suction valve spring (92) is disposed between the suction valve moving member (84) and a suction valve cover (94). In another exemplary embodiment (not shown), the suction valve moving member (84) may be slidably retained on a suction valve stud, in a manner analogous to the discharge valve moving member (124) and the discharge valve stud (125), as discussed below. In the exemplary embodiment, no such suction valve stud is present, and the suction valve moving member (84) is biased by the suction valve spring (92) to engage the suction valve seat surface (82) and occlude the suction valve aperture (91), whereupon the suction valve mechanism is in the closed state. When the working fluid pressure in the fluid end body plunger bore (32) decreases, the suction force acting on the suction valve moving member (84) exceeds the biasing force of the suction valve spring (92) and causes the suction valve moving member (84) to move away from the suction valve seat surface (82) and thereby increase an open area of the suction valve aperture (91), whereupon the suction valve mechanism is in the open state. In the exemplary embodiment, the suction valve seat member (90) and the suction valve moving member (84) are made of AISI 4340 grade steel. In other embodiments (not shown), other types of suction valve mechanisms known in the art that are suitable for use in fluid end assemblies may be used.

In the exemplary embodiment, as shown in FIGS. 1, 6 and 7, the suction valve assembly (80) is a cartridge style suction valve assembly (80) wherein the suction valve assembly further comprises a suction valve body (86). Each suction valve body (86) is sized and shaped for insertion into one of the suction valve ports (56). The suction valve body (86) retains the suction valve mechanism, and directly or indirectly engages one or both of the suction manifold (50) and the fluid end body (20) to limit movement of the suction valve mechanism.

In the exemplary embodiment, as shown in FIG. 7, the suction valve body (86) is formed collectively by the suction valve seat member (90), and a suction valve cover (94) removably attached to the suction valve seat member (90) by a threaded connection, and a suction valve cage (96) which is attached to the suction valve seat member (90) by a threaded connection. It will be appreciated that any one or more of the suction valve seat member (90), suction valve cover (94) and suction valve cage (96) may be selectively detached from each other and selectively repaired or replaced. In other embodiments (not shown), the suction valve body (86) may be formed by one or a plurality of components.

In the exemplary embodiment, it will be noted that the suction valve body (86) effectively lines the internal walls of the suction manifold (50) and the fluid end body (20) defining the suction valve port (56), so as to form a barrier between fluid flowing through the suction valve (80) and the internal walls of the suction manifold (50). Accordingly, the suction valve body (86) components may be allowed to sacrificially erode to protect these internal walls.

In the exemplary embodiment, the suction valve body (86) defines a substantially cylindrical outer envelope around all or at least part of the suction valve mechanism. The suction valve body (86) fits in a substantially vertical orientation, and within close tolerance of the substantially cylindrical suction valve port (56), and is sealed against the suction manifold (50) by suction valve sealing elements (104). Referring to FIG. 6, a suction valve body bottom bearing surface (98) abuts a horizontal fluid end body internal shoulder (40), while a suction valve body top bearing surface (100) abuts a suction valve retaining member in the form of a suction valve cover nut (102) that is removably attached to the suction manifold (50) by a threaded connection to limit movement of the suction valve assembly (80) within the suction valve port (56). It will be appreciated that movement of the suction valve assembly (80) within the suction valve port (56) is thereby limited, without the need for the suction valve assembly (80) to have a tapered profile, or reliance on radial compression of the components of the suction valve assembly (80), the suction manifold (50) and the fluid end body (20), or a friction fit mechanism therebetween. Further, it will be appreciated that suction valve assembly (80) may be removed from the suction valve port (56), by unscrewing the suction valve cover nut (102) and pulling the suction valve assembly (80) upwardly out of the suction valve port (56) without having to remove the suction manifold (50) from the fluid end body (20).

In the exemplary embodiment, the suction valve assembly (80) has an attached locating member (108) to fix the angular orientation of the suction valve assembly (80) when disposed within the suction valve port (56) to ensure that the apertures defined by the sidewalls of the suction valve cages (96) are oriented to permit fluid communication between at least one of the suction manifold inlets (52) and the suction valve mechanism. In the exemplary embodiment, for example, the locating member (108) ensures that the apertures defined by the sidewalk of the suction valve cages (96)

are coaxially aligned with both of the suction manifold inlets (52) such that the working fluid can flow from either one or both of the suction manifold inlets (52) to the interior of each of the suction valve cages (96). In an exemplary embodiment, the locating member (108) may be a set screw or bolt that is received within a notch (106) that extends radially inwards from the peripheral edge of the upward facing portion of the suction valve cage (96), and is attached to the suction valve cage (96) by a threaded end connection. In an alternative embodiment, the locating member (108) may be a key that is disposed within the notch (106) and soldered or welded to the suction valve cage (96). The locating member (108) extends radially beyond the peripheral edge of the substantially cylindrical outer envelope of the suction valve assembly (80) so as to engage a contour defined by the suction manifold (50) (such an internal slot or notch formed in the suction manifold (50)), thus preventing rotation of the suction valve assembly (80) within the suction valve port (56).

Discharge valve assembly A purpose of the discharge valve assembly (120) is to regulate fluid communication between the fluid end body discharge outlet (36) and the discharge manifold outlet (72). The discharge valve assembly comprises a discharge valve mechanism that is variable between an open state and a closed state. In the open state, the discharge valve mechanism defines a discharge valve aperture permitting fluid communication between the fluid end body discharge outlet (36) and the discharge manifold outlet (72). In the closed state, the discharge valve mechanism may entirely close or reduce the open area of the discharge valve aperture, relative to the open state, thereby preventing or restricting fluid communication through the discharge valve mechanism.

Figure 9:
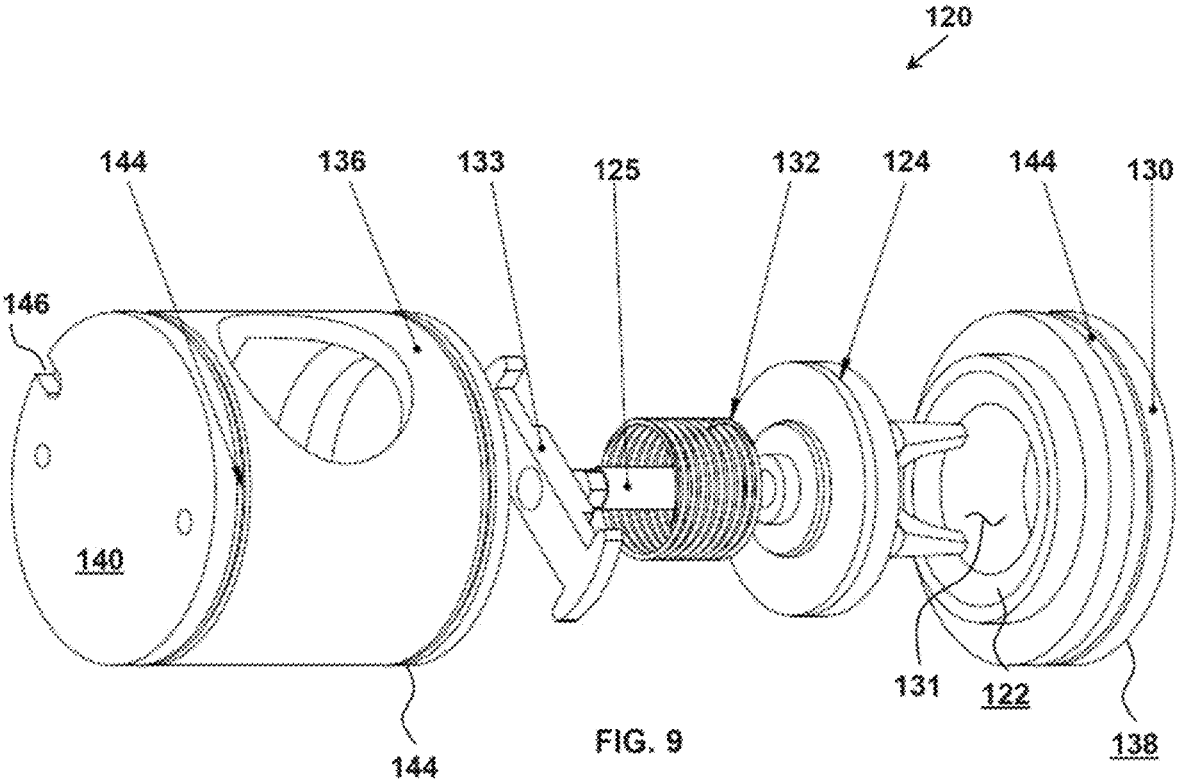
FIG. 9 is an exploded perspective view of an embodiment of a discharge valve assembly of the embodiment of the fluid end assembly shown in FIG. 1.

In the exemplary embodiment, as shown in FIG. 9, the discharge valve mechanism comprises discharge valve seat member (130) having a conical-section discharge valve seat surface (122), a discharge valve moving member (124), a discharge valve stud (125), a discharge valve spring (132), and a discharge valve retainer (133). The discharge valve seat member (130) defines a discharge valve aperture (131) permitting fluid communication between the discharge manifold (70) and the fluid end body suction inlet (34). The discharge valve spring (132) is disposed between the discharge valve moving member (124) and a discharge valve retainer (133). The discharge valve moving member (124) is slidably retained on the discharge valve stud (125), and biased by the discharge valve spring (132) to engage the discharge valve seat surface (122) and occlude the discharge valve aperture (131), whereupon the discharge valve mechanism is in the closed state. An increase in the working fluid pressure in the fluid end body plunger bore (32) urges the discharge valve moving member (124) against the biasing force of the discharge valve spring (132) to move away from the discharge valve seat surface (122) and thereby increase an open area of the discharge valve aperture (131), whereupon the discharge valve mechanism is in the open state. In the exemplary embodiment, the discharge valve seat member (130) and the discharge valve moving member (124) are made of AISI 4340 grade steel. In other embodiments (not shown), other types of discharge valve mechanisms known in the art that are suitable for use in fluid end assemblies may be used.

In the exemplary embodiment, the discharge valve assembly (120) is a cartridge-style discharge valve assembly (120) wherein the discharge valve assembly (120) further comprises a discharge valve body (126). Each discharge valve body (126) is sized and shaped for insertion into one of the discharge valve ports (76), retains the discharge valve mechanism, and directly or indirectly engages one or both of the discharge manifold (70) and the fluid end body (20) to limit movement of the discharge valve mechanism.

Figure 10:
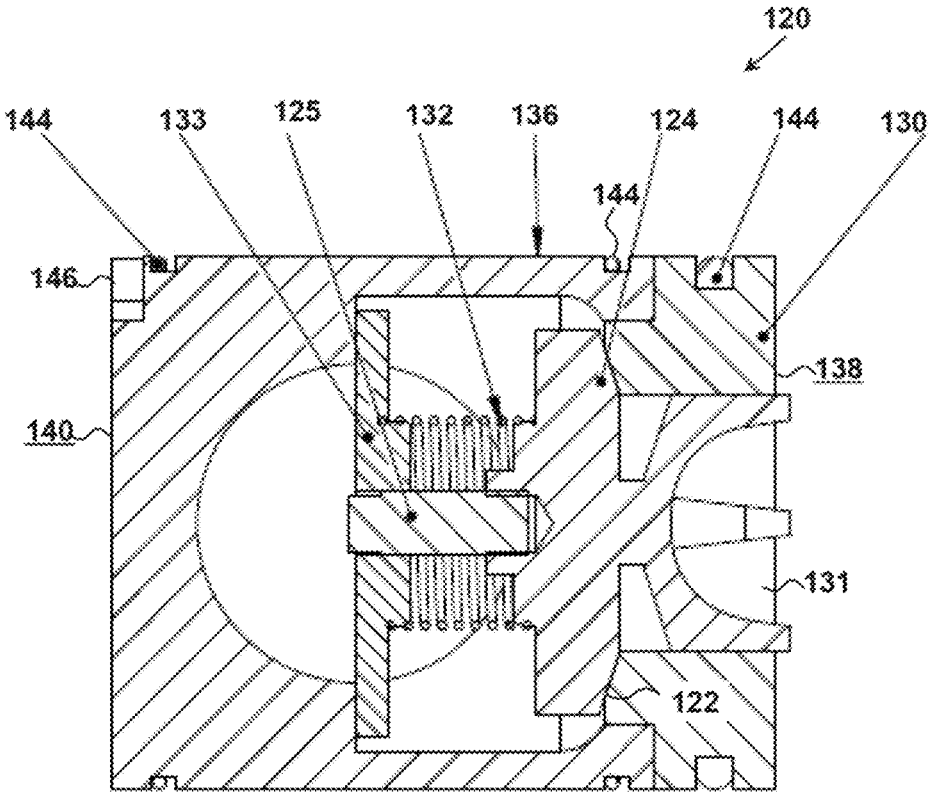
FIG. 10 is a mid-line cross-sectional view of the embodiment of the discharge valve assembly shown in FIG. 9.

In the exemplary embodiment, as shown in FIG. 10, the discharge valve body (126) is formed collectively by the discharge valve seat member (130), and a discharge valve cage (136) removably attached to the discharge valve seat member (130) by a threaded connection. It will be appreciated that the discharge valve seat member (130) and discharge valve cage (136) may be selectively detached from each other and selectively repaired or replaced. In other embodiments (not shown), the discharge valve body (126) may be formed by one or a plurality of components.

In the exemplary embodiment, as shown in FIG. 6, it will be noted that the discharge valve body (126) effectively lines the internal walls of the discharge manifold (70) and the portion of the fluid end body (20) defining the discharge valve port (76), so as to form a barrier between fluid flowing through the discharge valve assembly (120) and the internal walls of the discharge manifold (70). Accordingly, the discharge valve body (126) components may be allowed to sacrificially erode to protect these internal walls.

In the exemplary embodiment, the discharge valve body (126) defines a substantially cylindrical outer envelope around all or at least part of the discharge valve assembly (120). The discharge valve body (126) fits within close tolerance of the substantially cylindrical discharge valve port (76), and is sealed against the discharge manifold by discharge valve sealing elements (144). Referring to FIG. 6, a discharge valve body rear bearing surface (138) abuts a vertical fluid end body internal shoulder (42), while a discharge valve body front bearing surface (140) abuts a discharge valve retaining member in the form of a discharge valve cover nut (142) that is removably attached to the discharge manifold (70) by a threaded connection to limit movement of the discharge valve assembly (120) within the discharge valve port (76). It will be appreciated that movement of the discharge valve assembly (120) within the discharge valve port (76) is thereby limited, without the need for the discharge valve assembly (120) to have a tapered profile, and without reliance on radial compression of the components of the discharge valve assembly (120), the discharge manifold (70) and the fluid end body (20), or a friction fit mechanism therebetween. Further, it will be appreciated that discharge valve assembly (120) may be removed from the discharge valve port (76), by unscrewing the discharge valve cover nut (142) and pulling the discharge valve assembly (120) forwardly out of the discharge valve port (76) without having to remove the discharge manifold (70) from the fluid end body (20).

In the exemplary embodiment, the discharge valve assembly (120) has an attached locating member (148) to fix the angular orientation of the discharge valve assembly (120) when disposed within the discharge valve port (76) to ensure that the apertures defined by the sidewalls the discharge valve cages (136) are oriented to permit fluid communication between at least one of the discharge manifold outlets (72) and the discharge valve mechanism. In the exemplary embodiment, for example, the locating member (148) ensues that the apertures defined by the sidewalls of the discharge valve cages (136) are coaxially aligned with both of the discharge manifold outlets (72) such that the working fluid can flow from the interior of each of the discharge valve cages (136) to either one or both of the discharge manifold outlets (72). In an exemplary embodiment, the locating member (148) may be a set screw or bolt that is received within a notch (146) that extends radially inwards from the peripheral edge of the forward facing portion of the discharge valve cage (136), and is attached to the discharge valve cage (136) by a threaded end connection. In an alternative embodiment, the locating member (148) may be a key that is disposed within the notch (146) and soldered or welded to the discharge valve cage (136). The locating member (148) extends radially beyond the peripheral edge of the substantially cylindrical outer envelope of the discharge valve assembly (120) so as to engage a contour defined by the discharge manifold (70) (such an internal slot or notch formed in the discharge manifold (70)), thus preventing rotation of the discharge valve assembly (120) within the discharge valve port (76).

The present invention has been described above and shown in the drawings by way of exemplary embodiments and uses, having regard to the accompanying drawings. The exemplary embodiments and uses are intended to be illustrative of the present invention. It is not necessary for a particular feature of a particular embodiment to be used exclusively with that particular exemplary embodiment. Instead, an of the features described above and/or depicted in the drawings can be combined with any of the exemplary embodiments, in addition to or in substitution for any of the other features of those exemplary embodiments. One exemplary embodiment's features are not mutually exclusive to another exemplary embodiment's features. Instead, the scope of this disclosure encompasses any combination of any of the features. Further, it is not necessary for all features of an exemplary embodiment to be used. Instead, any of the features described above can be used, without any other particular feature or features also being used. Accordingly, various changes and modifications can be made to the exemplary embodiments and uses without departing from the scope of the invention as defined in the claims that follow.

The embodiments of the invention in which an exclusive property or privilege is claimed are defined as follows:

1. A fluid end assembly for use with a reciprocating pump comprising a reciprocating plunger, the fluid end assembly comprising:

(a) a fluid end body defining: a fluid end body plunger bore for receiving the reciprocating plunger; a fluid end body suction inlet in fluid communication with the fluid end body plunger bore; and a fluid end body discharge outlet in fluid communication with the fluid end body plunger bore, wherein the fluid end body suction inlet is disposed above the fluid end body discharge outlet;

(b) a suction manifold removably attached to a top surface of the fluid end body over the fluid end body suction inlet; and a discharge manifold removably attached to a side surface of the fluid end body over the fluid end body discharge outlet;

each manifold defining a manifold fluid aperture, and a valve port extending inwardly from an external surface of the manifold;

(c) a suction valve assembly and a discharge valve assembly, each valve assembly comprising: a valve mechanism variable between an open state and a closed state, wherein an open area of a valve aperture permitting fluid communication between the manifold fluid aperture and the plunger bore is greater in the open state than in the closed state; and a valve body for retaining the valve mechanism, wherein the valve body is sized and shaped for insertion into and removal from the valve port while the manifold is attached to the fluid end body.

2. The fluid end assembly of claim 1, wherein movement of each valve assembly within the respective valve port is limited by abutment between the respective valve body and a respective internal shoulder defined by the respective manifold.

3. The fluid end assembly of claim 1, wherein movement of each valve assembly within the respective valve port is limited by abutment between the respective valve body and a respective retaining member removably attachable to the respective manifold.

4. The fluid end assembly of claim 3, wherein the respective retaining member is removably attachable to the respective manifold with a threaded connection.

5. The fluid end assembly of claim 1, wherein each valve body defines an outer envelope around a portion or all of the respective valve mechanism.

6. The fluid end assembly of claim 5, wherein each outer envelope is shaped to line an internal wall of the respective manifold defining the respective valve port, thereby forming a barrier between fluid flowing through the respective valve assembly and the internal wall.

7. The fluid end assembly of claim 5, wherein the outer envelope is substantially cylindrical in shape.

8. The fluid end assembly of claim 1, wherein the reciprocating pump comprises a plurality of the reciprocating plungers, and the fluid end assembly comprises a plurality of the fluid end bodies corresponding in number to number of reciprocating plungers, wherein each of the fluid end bodies are separate from each other, and removably attachable directly or indirectly to the power end assembly independently of the other fluid end bodies.

9. The fluid end assembly of claim 1, wherein the reciprocating pump comprises a plurality of the reciprocating plungers, and the fluid end assembly comprises a plurality of the fluid end bodies corresponding in number to number of reciprocating plungers, wherein each of the fluid end bodies are separate from each other, and removably attachable directly or indirectly to the manifold independently of the other fluid end bodies.

10. The fluid end assembly of claim 1, wherein the fluid end body plunger bore and the fluid end body discharge outlet are coaxially aligned with each other.

11. A fluid end body of a fluid end assembly of a reciprocating pump comprising a reciprocating plunger, the fluid end body defining:

(a) a fluid end body plunger bore for receiving the reciprocating plunger;

(b) a fluid end body suction inlet in fluid communication with the fluid end body plunger bore; and (c) a fluid end body discharge outlet in fluid communication with the fluid end body plunger bore, wherein the fluid end body suction inlet is disposed above the fluid end body discharge outlet, allowing a suction manifold to be removably attached to a top surface of the fluid end body over the fluid end body suction inlet; and a discharge manifold to be removably attached to a side surface of the fluid end body over the fluid end body discharge outlet;

wherein the fluid end body plunger bore and the fluid end body discharge outlet are coaxially aligned with each other.

* * * * *